United States Patent [19]

Blotenberg

[11] Patent Number: 4,946,343

[45] Date of Patent: Aug. 7, 1990

[54] METHOD OF REGULATION THAT PREVENTS SURGE IN A TURBOCOMPRESSOR

[75] Inventor: Wilfried Blotenberg, Dinslaken, Fed. Rep. of Germany

[73] Assignee: MAN Gutehoffnungshütte AG, Fed. Rep. of Germany

[21] Appl. No.: 321,518

[22] Filed: Mar. 9, 1989

[30] Foreign Application Priority Data

Mar. 24, 1988 [DE] Fed. Rep. of Germany ..... 3809881

[51] Int. Cl.[5] ..... F04D 27/02

[52] U.S. Cl. ..... 415/27; 364/172; 364/181

[58] Field of Search ..... 415/1, 13, 17, 26, 27, 415/28, 47, 48, 23, 14; 364/167.01, 181, 172, 153, 154, 162

[56] References Cited

U.S. PATENT DOCUMENTS

| | | | |
|---|---|---|---|
| 4,139,328 | 2/1979 | Kuper et al. | 415/27 |
| 4,298,310 | 11/1981 | Blotenberg | 415/1 |
| 4,384,818 | 5/1983 | Blotenberg | 415/27 |
| 4,486,142 | 12/1984 | Staroselsky | 415/27 |
| 4,560,319 | 12/1985 | Blotenberg | 415/26 |
| 4,594,050 | 6/1986 | Gaston | 415/47 |
| 4,697,980 | 10/1987 | Keyes, IV et al. | 415/1 |
| 4,774,674 | 9/1988 | Otake | 364/181 |
| 4,781,524 | 11/1988 | Blotenberg | 415/1 |
| 4,789,298 | 12/1988 | Blotenberg | 415/1 |
| 4,796,213 | 1/1989 | Blotenberg | 415/1 |
| 4,831,534 | 5/1989 | Blotenberg | 415/1 |
| 4,831,535 | 5/1989 | Blotenberg | 415/1 |
| 4,882,528 | 11/1989 | Sogabe et al. | 364/167.01 |

FOREIGN PATENT DOCUMENTS

| | | | |
|---|---|---|---|
| 38196 | 2/1986 | Japan | 415/13 |
| 2818977 | 11/1978 | U.S.S.R. | 415/23 |

*Primary Examiner*—Edward K. Look
*Assistant Examiner*—John T. Kwon
*Attorney, Agent, or Firm*—Max Fogiel

[57] ABSTRACT

A regulating method for preventing surges in turbocompressors, in which the compressor flow and forwarding pressure are continuously measured. The compressor operating point is defined by the compressor flow and the forwarding pressure. Surges are prevented by regulating the opening of at least one blow-off valve by a regulator with an adjustment parameter when the operating point has arrived at a blow-off curve that parallels a surge limit, but before the operating point arrives at the surge limit. The adjustment parameter is returned to an actual state of the blow-off valve by a readjustment circuit when a difference exceeding a predetermined threshold occurs betwen the actual state of the blow-off valve and the adjustment parameter of the regulator.

10 Claims, 3 Drawing Sheets

METHOD OF REGULATION THAT PREVENTS SURGE IN A TURBOCOMPRESSOR

Figure 1:
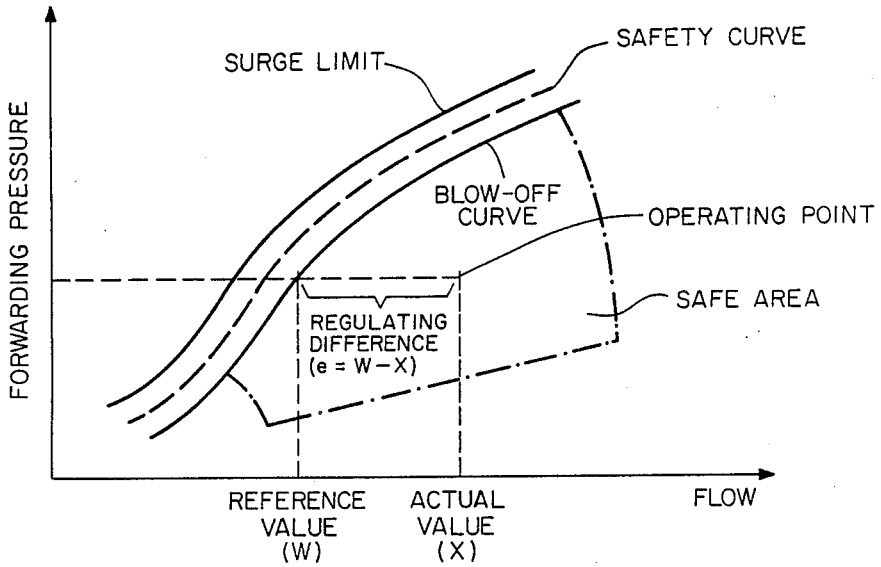

A method of regulation of this type is known from German Pat. No. 2 623 899. Methods of regulation of this type usually employ proportional-integral regulators that are operated at a high proportional amplification for reasons of safety. When rapid malfunctions, a sudden decrease in flow for example, occur, the regulator operates mainly as a proportional regulator. This leads to changes in its output signal, the adjustment parameter, in proportion to its input parameter, the regulating difference, with the adjustment parameter decreasing as the regulating difference increases and vice versa. Due to the high proportional amplification, which is in certain situations increased even further by the effect of a non-linear amplifier, the change in the adjustment parameter can be as much as approximately 100% for example, even when the change in the regulating difference is small, −10% for example. Although this does initially shift the operating point relatively rapidly back out of the impermissible and dangerous area of the performance field and beyond the blow-off curve when a malfunction occurs, the operating point will subsequently travel beyond the blow-off curve again and remain there for quite some time. The reason for this is the slow change in the integral component of the regulator. The consequences are a decrease in the safe operation of the compressor in relation to surging, especially when a series of brief malfunctions occurs in the network of equipment downstream of the compressor, and definite fluctuations of pressure in the network. The consequence is that either an increased risk of damage to the compressor or a greater and less economical distance away from the surge limit must be taken into account.

The object of the invention is accordingly to provide a method of the aforesaid type that will reliably eliminate the aforesaid drawbacks even in special situations like the occurrence of a series of brief malfunctions in the network of equipment and that will allow the compressor to be operated economically, with the operating point closer to the surge limit that is, with no sacrifice of safety.

This object is attained in accordance with the invention in a method of the aforesaid type that is characterized in that, when a discrepancy between the actual state ($y_a$) of the blow-off valve (21) and the adjustment parameter (u) of the regulator (5) that exceeds a prescribed threshold occurs, a readjustment circuit (9) returns the adjustment parameter to the actual state of the blow-off valve.

In the new method, the instant the operating point travels back over the blow-off curve again, the regulator provides at its output terminal an adjustment parameter that essentially equals the instantaneous state of the blow-off valve. Regulation can accordingly continue without a disruptively long period of adjustment, preventing the operating point from traveling beyond the blow-off curve again until the compressor arrives at a new stationary operating state. In contrast to the known method of regulation, the operating point leaves the dangerous area of the performance field and approaches the blow-off curve asymptotically. The compressor is accordingly better protected against surging and can be operated closer to the surge limit at a high level of safety, meaning more economically. To avoid unnecessary intervention on the part of the readjustment circuit, which might make the regulation process unstable, the readjustment process is not initiated until there is a difference between the regulator adjustment parameter and the state of the blow-off valve that exceeds a prescribed threshold. The purpose of the threshold is to keep any noise that occurs in regulating differences derived by measurement from affecting the readjustment circuit. The threshold must be high enough to prevent it from being exceeded by noise. In contrast to the known methods of regulation, wherein safety considerations do not allow the regulator adjustment parameter to be directly varied by hand, the new method makes it possible to manually control the regulator output terminal. If for example the blow-off valve is manually opened farther than the regulator will actually allow during the adjustment process, although the regulator will receive a negative regulating difference at its input terminal, the valve-state adjustment parameter will be brought into alignment by the subsequent readjustment process, preventing the sometimes very wide discrepancies between the adjustment parameter and the state of the valve that have occurred previously.

One embodiment of the method, wherein the blow-off valve can be adjusted by a manual control procedure that acts on the intake end of the regulator, is characterized in that, during the adjustment of the blow-off valve that supersedes the regulator, the adjustment parameter for the regulator is indirectly adjusted to the actual state of the blow-off valve by adjusting the reference value for the manual control procedure to the actual state of the blow-off valve by means of a readjustment circuit. In this version of the method, accordingly, the regulator is not adjusted directly but indirectly. The advantage is that it is unnecessary to intervene in the regulator itself, but only to manipulate the manual controls.

Another version of the method of regulation, wherein safety controls partly or completely open the blow-off valve once the operating point has attained a safety curve that extends between the surge limit and the blow-off curve is characterized in that the readjustment of the regulator to the actual state of the blow-off valve is synchronized with the activation of the safety controls. The regulator will accordingly smoothly and continuously resume the regulating process subsequent to readjustment of the safety controls, also avoiding the aforesaid drawbacks. The safety controls can act either directly on the regulator output or on the manual-controls reference value.

When, as is conventional in methods of regulation of the aforesaid type, the regulator is a proportional-integral regulator with a proportional amplifier and a readjustment integrator with its outputs added in a summing stage, a control command generated by the readjustment circuit can switch the readjustment integrator back and forth between integration at a prescribed time constant, representing the normal state and a practically instantaneous readjustment of its output. The integrator will in this case not be directly readjusted to an adjustment parameter that corresponds to the actual state of the blow-off valve but to a parameter that has been decreased by the product of the regulating difference and the amplification factor of the proportional component of the regulator. This procedure will retain the precise actual parameter, which is of course obtained by adding the outputs of the proportional section and the integral section, at the output terminal of the proportional-integral regulator. This version is especially simple and inexpensive.

In a further development of the previously described method of regulation wherein the regulator is indirectly readjusted, a readjustment integrator that can be switched back and forth between integration and readjustment of its output to a value that corresponds to the actual state of the blow-off valve by a control command generated by the readjustment circuit is employed in the manual controls. This version is also inexpensive and can accordingly be manufactured very simply and to advantage.

In one preferred embodiment of the method of regulation, the difference between the adjustment parameter at the output terminal of the regulator and the state of the blow-off valve is constructed in the readjustment circuit and compared with a prescribed threshold and a logical control signal that shifts the downstream readjustment integrator in the regulator or in the manual controls to the readjustment state and maintains it there is generated at the output terminal of the readjustment circuit from the result of the comparison and from the output signal from the safety controls by a logical AND operation as long as the difference exceeds the threshold. The AND operation is intended to ensure that the regulator will be readjusted either when the prescribed threshold for the difference between the adjustment parameter and the state of the valve is exceeded or when the safety controls are readjusted. The particular advantage is that, when the safety controls are triggered, the process of readjusting the regulator will commence immediately and not only after the adjustment parameter and the state of the valve have already separated to the extent of the difference threshold. This embodiment of the method is also simple to carry out and accordingly inexpensive to implement in digital or analog form or in a combination thereof.

In a further development of the embodiment just described, the difference is compared with reference to its mathematical sign with a separate prescribed threshold. Monitoring the difference between the adjustment parameter and the state of the blow-off valve with respect to exceeding different thresholds in relation to positive and negative values allows different deviations in different directions.

In another version of the embodiment of the method, the absolute value of the difference between the adjustment parameter and the state of the blow-off valve is obtained and employed in the stages of the method subsequent to construction of the difference instead of the difference itself. The two version differ in how the readjustment process is triggered. In the first, readjustment occurs only in one direction and specifically in accordance with the mathematical sign of the difference, either when the adjustment parameter is higher than the state of the valve or when it is lower. In the second version, the readjustment process is triggered independent of direction whenever a prescribed difference between the adjustment parameter and the state of the valve is exceeded.

Furthermore, the regulator can be shifted from readjustment to regulation subsequent to a prescribed delay once the corresponding control signal has been reset. The advantage of this procedure is that the blow-off valve will still have a certain amount of time to assume a stationary state. A device of this type is especially practical in compressors wherein the action of the blow-off valve or its drive mechanism is delayed. For technical reasons it can for example happen that the blow-off valve will not adhere in the state it attains directly after a rapid-opening command has been canceled but will keep on changing to some extent subject to the effects of the delay or even exhibit hunting behavior around the new state. Without appropriate countermeasures there would in this situation be a danger of the valve shifting to a state other than the stationary state during a direct shift back from readjustment to regulation.

The delay in accordance with the invention, however, ensures that the blow-off valve will already have attained its stationary state and that the regulator output terminal can reliably be readjusted to the correct state of the valve.

If the state of the valve can be measured only unreliably or expensively, it can also be determined indirectly. In this case, the behavior of the blow-off valve is simulated in a circuit with an input that represents the particular adjustment parameter of the regulator and with an output that represents a calculated blow-off valve state.

Figure 2A:
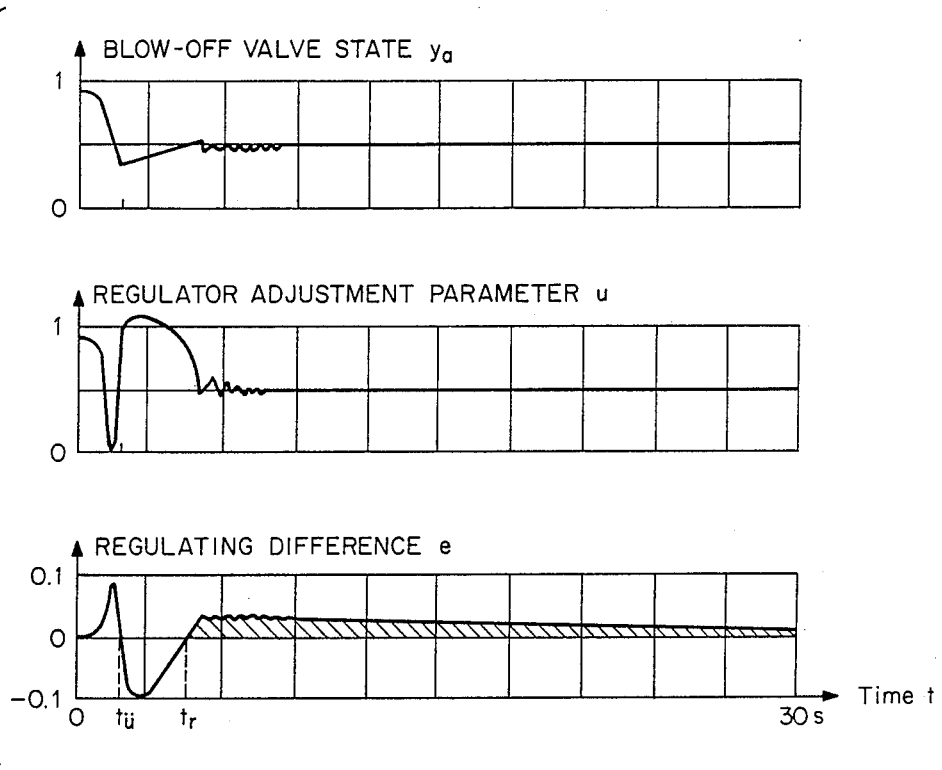
Figure 2B:
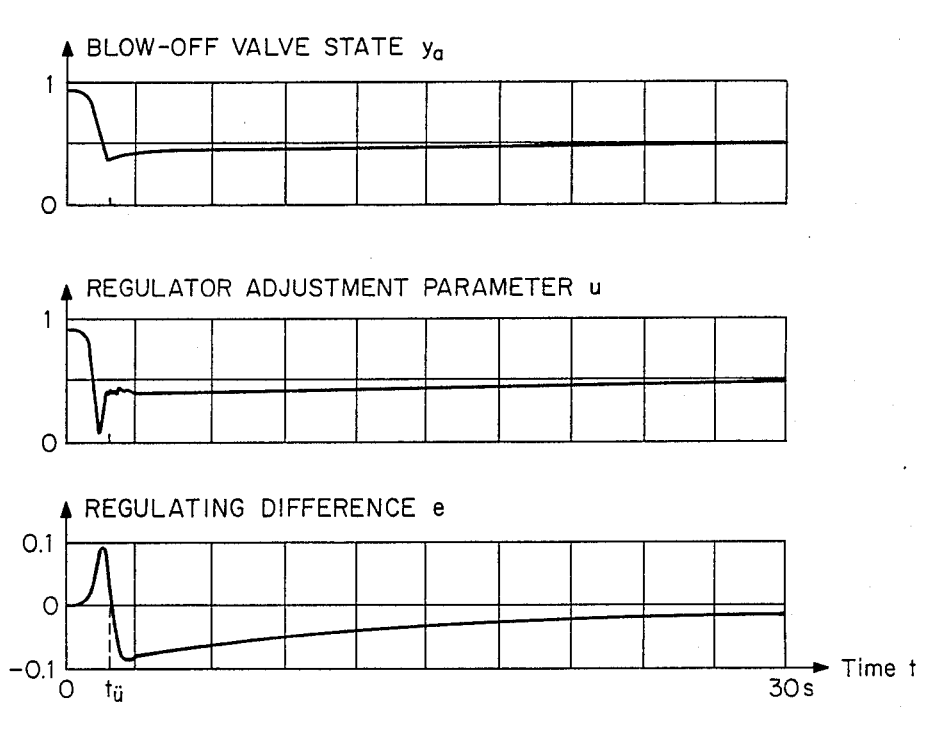
Figure 3:
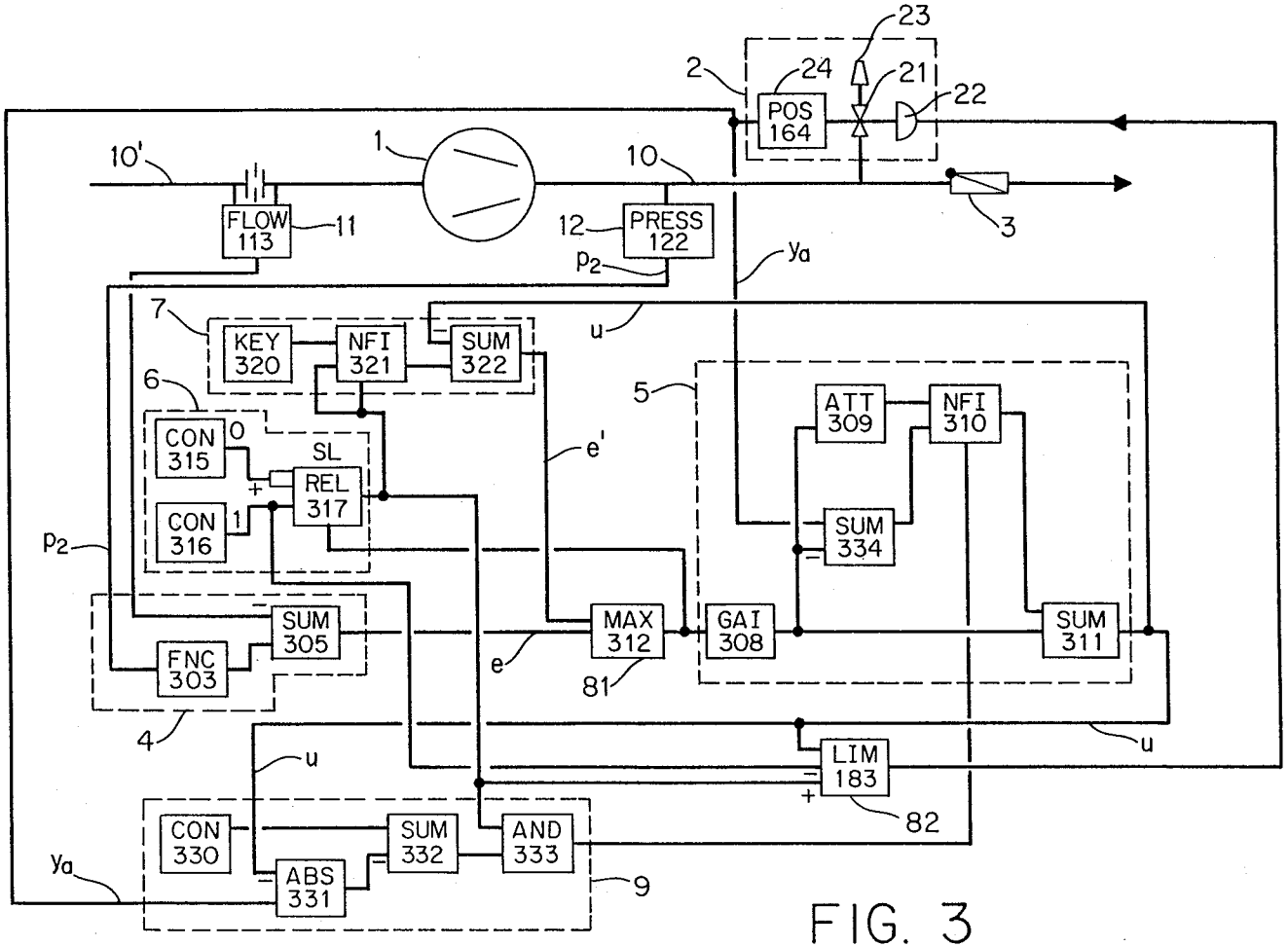

The method will now be explained by way of example with reference to the drawing, wherein FIG. 1 is a graph of the performance field of a turbocompressor, FIG. 2*a* is a graph of the regulation behavior as a function of time of a regulator that operates at the state of the art, FIG. 2*b* is a graph of the regulation behavior as a function of time of a regulator that operates in accordance with the invention, and FIG. 3 is a block diagram of a turbocompressor with controls and regulating elements for carrying out the method of regulation.

The abscissa of the graph in FIG. 1 represents the flow through the compressor and the ordinate the forwarding pressure. The particular operating point is accordingly represented by a pair of values consisting of the instantaneous flow and instantaneous forwarding pressure and is conventionally continuously detected by appropriate instruments. The graph also shows a sheaf of three parallel curves, of which the left is the surge limit, the middle curve the safety curve, and the right the blow-off curve. The surge limit is dictated by the compressor's technical properties and is usually determined empirically. The safety curve parallels the surge limit at a fixed distance. As soon as the operating point arrives at the safety curve, the blow-off valve is completely opened as rapidly as possible to avoid surging. The blow-off curve is the curve at which, once the regulator reaches it, a regulated opening of the blow-off valve is commenced in order to shift the operating point back into the area to the right of the blow-off curve, the area in which the compressor is operating safely. This safe-operations area is demarcated in the performance field by the blow-off curve and the dot-and-dash line.

The regulating difference e employed in the method of regulation is defined as the difference between the reference flow w and the actual flow x—e=w−x. When the regulating difference has a negative mathematical sign, accordingly, the compressor operating point will be in the safe area. When the regulating difference has a positive mathematical sign on the other hand, the operating point will have crossed to the left of the blow-off curve, toward the surge limit, that is. When the operating point crosses the surge limit, the compressor will begin to surge and can be considerably damaged. This situation must accordingly be avoided as reliably as possible.

FIGS. 2*a* and 2*b* illustrate a method of regulation at the state of the art and a method of regulation in accordance with the invention respectively. The graphs show the regulating difference e supplied to the regulator, the adjustment parameter u generated at the output terminal of the regulator, and the state $y_a$ of the blow-off valve. At time t=0 sec a malfunction occurs in the network of equipment downstream of the turbocompressor and activates the regulator which begins opening the blow-off valve. This in turn leads to detection of a regulating difference e that increases from zero to a positive value, meaning that the operating point is in the impermissible area of the performance field to the left of the blow-off curve and to the right of the safety curve. The regulator will accordingly vary its adjustment parameter u, opening the blow-off valve farther. The 1 in the figure corresponds to a completely closed blow-off valve and the 0 to a completely open blow-off valve.

Since the blow-off valve is opening, regulating difference e will decrease again until, at time t, it becomes negative, and will keep on moving in the negative direction as the blow-off valve continues opening. Regulator adjustment parameter u will accordingly increase again and the motion of the blow-off valve will be reversed. For a certain amount of time, up to time $t_r$, that is, regulating difference e will now be negative and will approach 0, indicating that the operating point has returned to the safe area of the performance field to the right of the blow-off curve. Subsequent to time $t_r$, however, regulating difference e will again exceed the zero line and assume positive values, meaning that the operating point is again in the impermissible area of the performance field on the other side of the blow-off curve. Only after a longer period of time, more than 30 seconds in the illustrated example, will regulating difference e travel away from the positive values and approach the zero line, a new stationary operating state, that is. During that interval, the operating point will be on the opposite side of the blow-off curve, as indicated by the hatching in FIG. 2*a*. This situation is accompanied by wide and slowly attenuating fluctuations in adjustment parameter u, as will be evident from the associated graph. The fluctuations are also present in the graph of the state $y_a$ of the blow-off valve, meaning that the valve is alternatingly moving in the opening and in the closing direction with decreasing amplitude. During this post-$t_r$ interval, the compressor will be more likely to surge and the pressure in the network of equipment downstream of the compressor will fluctuate periodically.

FIG. 3 illustrates one example of the method of regulation in accordance with the invention. The intake end of a turbocompressor 1 communicates with an intake line 10' and its outlet end with a pressure line 10. Branching off of pressure line 10 by way of a blow-off valve 21 is a blow-off line 23 that in the present case opens into the atmosphere. Downstream of the detour to blow-off valve 21 in pressure line 10 is a check valve 3, whence pressure line 10 continues to the network of equipment downstream of compressor 1.

The flow through intake line 10' is measured at the intake end by a procedure FLOW 113. The forwarding pressure $P_2$ in compressor 1 is gauged at the outlet end by a procedure PRESS 122. A regulating reference value, the minimum permissible flow at the particular forwarding pressure in the present case, is constructed from $P_2$ in a function generator FNC 303. A regulating difference e in the form of the difference between the reference value and the inflow result of measuring procedure FLOW 113 is constructed in a summing stage SUM 305. Blocks FNC 303 and SUM 305 can accordingly be combined into a regulating-difference generator 4.

Blocs GAI 308, ATT 309, NFI 310, and SUM 311 comprise a proportional-integral regulator 5 (PI regulator). The proportional amplification is established in amplifier GAI 308 and the regulator-readjustment time in attenuator ATT 309. Block NFI 310 is the integrator for proportional-integral regulator 5. The proportional component of regulator 5 is added to its integral component in block SUM 311. The function of block SUM 334 will be described hereinafter.

Blow-off valve 21 can be adjusted manually by way of blocks KEY 320, NFI 321, and SUM 322. The desired reference value for the blow-off valve is established in integrator NFI 321.

If the reference value is higher than the actual regulator output, its adjustment parameter u, that is, regulating difference e' will be positive. A procedure MAX 312 selects a maximum between e and e'. The regulator output, its adjustment parameter u, that is, is determined by manual-control procedure 7 or by regulating-difference generator 4.

To the extent described so far, the method conforms to the state of the art.

Blocks CON 315, CON 316, and REL 317 create a safety curve. When the output signal from maximum selector MAX 312 exceeds a threshold established in threshold stage REL 317, the output terminal of threshold stage will switch to 0, making the manual-control reference value e' shift suddenly to 0. The blow-off valve will accordingly open at maximum speed. If threshold stage REL 317 has switched back, the manual-control reference value will slowly rise again to its maximum level. It is also important for the output from block REL 317 to act on limiter LIM 183. When the safety curve is exceeded, the output terminal of REL 317 will accommodate a signal that causes adjustment parameter u to be decreased by 1 in LIM, meaning that it will assume a value of 0 or less. The blow-off valve will accordingly open at maximum speed.

Also novel in relation to the state of the art is the inclusion of a readjustment circuit 9 in the regulating system. Readjustment circuit 9 is in this case comprised of blocks CON 330, ABS 331, SUM 332, SUM 334, and AND 333. The difference between the adjustment parameter u for the output terminal of regulator 5 and the state $y_a$ of blow-off valve 21 is constructed in block ABS 331. The state of blow-off valve 21 is determined by a state-measurement procedure POS 164. If the difference constructed in block ABS 331 exceeds an amount stored as a constant in block CON 330, summing stage SUM 332 will emit a negative signal, shifting the readjustment integrator NFI 310 in regulator 5 over to readjustment. This means that the integrator will no longer be functioning as a normal integrator but will continuously assume the value available at its input terminal, at the output terminal of summing stage SUM 334, that is. The difference between the state $y_a$ of blow-off valve 21 and the regulating difference e or e' multiplied by the amplification factor of amplifier GAI 308 will accordingly be available at the readjustment input terminal of integrator NFI. The resulting readjustment circuit will ensure that the regulating output, adjustment parameter u, that is, will always be set to the actual state $y_a$ of the valve in the event of wide deviations between state $y_a$ and adjustment parameter u. Furthermore, a rapid-opening command issued to limiting stage LIM 183 by safety controls 6 will ensure that, when blow-off valve 21 opens, readjustment circuit 9 will return the integral component of regulator 5 to the actual state $y_a$ of the valve. It accordingly becomes possible to get along without further control intervention in regulator 5. Another advantage of this method of regulation is that the regulator output, its adjustment parameter u, that is, will not be completely reset at 0 when the safety controls respond, but will decrease only until it equals the actual state $y_a$ of blow-off valve 21. If, for example, a rapid-opening signal from safety controls 6 continues to exist only until blow-off valve 21 is half open, the valve would remain half open when the signal disappeared and the proportional-integral regulator would smoothly and continuously maintain the regulating process from that point on with no necessity for further control commands.

The adjustment parameter u at the output terminal of some regulators is identical with the output signal from the integrator. In this case it will be sufficient just to return the integrator to the actual setting $y_a$ of the valve. A correction parameter that differs from state $y_a$ will then be necessary only when regulator adjustment parameter u is constructed by the addition of various terms, of the integral and proportional components of the aforesaid proportional-integral regulator for example.

One possible device for carrying out the method in accordance with the invention consists as illustrated in FIG. 3 of a turbocompressor 1 with an intake line 10' and a pressure line 10 that accommodates a blow-off valve 21 and a check valve 3. Intake line 10' contains a flowmeter 11 and pressure line 10 a pressure gauge 12. Blocks FNC 303 and SUM 305 are combined in a practical way into a switching stage for regulating-difference generator 4. Downstream is a maximum-selection stage 81 that corresponds to block MAX in the regulating diagram.

Other practical circuit stages are a regulator 5, safety controls 6, manual controls 7, and readjustment circuit 9 along with the switching blocks previously described herein.

Blow-off valve 21 is conventionally adjusted by way of a drive mechanism 22. The actual state of blow-off valve 21 can be communicated by way of a state sensor 24 that corresponds to the block POS 164. Components 22 and 24 constitute in conjunction with blow-off valve 21 and blow-off line 23 a blow-off unit 2.

The regulating-procedure flow chart in FIG. 3 can of course be supplemented with such additional components as for example filters to attenuate noise in the results of flow-measurement procedure FLOW 113 and pressure-measurement procedure PRESS 122.

I claim:

1. A regulating method for preventing surges in a turbocompressor comprising the steps: measuring continuously compressor flow and forwarding pressure, said compressor flow and forwarding pressure defining an operating point; preventing surge by regulating opening of at least one blow-off valve by a regulator with an adjustment parameter when said operating point has arrived at a blow-off curve that parallels a surge limit but before said operating point arrives at the surge limit; returning said adjustments parameter to an actual state of said blow-off valve by a readjustment circuit when a difference exceeding a predetermined threshold occurs between the actual state of the blow-off valve and said adjustment parameter of said regulator.

2. A method as defined in claim 1, including the step of adjusting said blow-off valve by a manual control procedure acting on an intake end of said regulator, adjustment of said blow-off valve superceding said regulator; adjusting indirectly said adjustment parameter for said regulator to the actual state of the said blow-off valve by adjusting a reference value for the manual control procedure to the actual state of the blow-off valve by said readjustment circuit during adjustment of said blow-off valve.

3. A method as defined in claim 2, including the step of providing manual controls for said manual control procedure with a readjustment integrator switchable back and forth between integration and readjustment of said readjustment integrators output to a value corresponding to the actual state of said blow-off valve by a control command generated by said readjustment circuit.

4. A method as defined in claim 2, including the step of: forming a difference between said adjustment parameter at an output of said regulator and the state of said blow-off valve in said readjustment circuit; comparing said difference with a predetermined threshold and a logical control signal shifting a downstream readjustment integrator in said regulator or in manual controls to a readjustment state, said logical control signal maintaining said readjustment state and being generated at an output of said readjustment circuit from a result of a comparison and from an output signal of safety controls by a logical AND operation as long as said difference exceeds said predetermined threshold.

5. A method as defined in claim 4, including the step of comparing said difference with reference to the mathematical sign of said difference with a separate predetermined threshold.

6. A method as defined in claim 4, including the step of generating the absolute value of said difference between said adjustment parameter and the state of said blow-off valve; and using said absolute value in stage of the method subsequent to formation of said difference.

7. A method as defined in claim 1, wherein said safety controls at least partly open said blow-off valve when said operating point has attained a safety curve extending between said surge limit and said blow-off curve; and synchronizing readjustment of said regulator to the actual state of said blow-off valve with activation of said safety controls.

8. A method as defined in claim 1, wherein said regulator is a proportional-integral regulator with a proportional amplifier and a readjustment integrator; adding outputs of said proportional amplifier and said readjustment integrator in a summing stage; generating a control command by said readjustment circuit for switching said readjustment integrator back and forth between integration at a predetermined time constant representing normal state and substantially instantaneous readjustment of said readjustment integrators output, whereby the output of said readjustment integrator is readjusted to a parameter decreased by a product of a regulating difference and an amplification factor of said proportional amplifier of said regulator.

9. A method as defined in claim 1, including the step of shifting said regulator from readjustment to regulation subsequent to a predetermined delay when a corresponding control signal has been reset.

10. A method as defined in claim 1, including the step of simulating behavior of said blow-off valve in a circuit with an input representing a particular adjustment parameter of said regulator, said circuit having an output representing a calculated blow-off valve state.

* * * * *